United States Patent [19]

Yoneda

[11] Patent Number: 4,669,404

[45] Date of Patent: Jun. 2, 1987

[54] DEVICE FOR TRAVELLING A CLOTH CLAMP IN AN AUTOMATIC SEWING MACHINE

[75] Inventor: Katsuki Yoneda, Nishinomia, Japan

[73] Assignee: Satoh Seiki Co. Ltd., Japan

[21] Appl. No.: 839,958

[22] Filed: Mar. 17, 1986

[30] Foreign Application Priority Data

Aug. 30, 1985 [JP] Japan ..... 60-192748

[51] Int. Cl.[4] ..... D05B 3/12; D05B 21/00

[52] U.S. Cl. ..... 112/121.12; 112/70; 112/121.15

[58] Field of Search ..... 112/121.12, 121.15, 112/70, 65

[56] References Cited

U.S. PATENT DOCUMENTS

| | | | |
|---|---|---|---|
| 3,653,345 | 4/1972 | Bianchi | 112/65 |
| 3,745,946 | 7/1973 | Bianchi | 112/65 |
| 3,911,838 | 10/1975 | Nelli | 112/70 |
| 4,096,810 | 6/1978 | Bianchi | 112/121.15 X |

*Primary Examiner*—H. Hampton Hunter

*Attorney, Agent, or Firm*—Larson and Taylor

[57] ABSTRACT

A device for moving a cloth clamp in an automatic sewing machine with desired speed variations which are necessary to change stitch densities during a sewing travel, wherein the speed variation is attained by arranging a hydraulic-pneumatic circuit including solenoid operated valves and other control elements in branched routes.

2 Claims, 3 Drawing Figures

DEVICE FOR TRAVELLING A CLOTH CLAMP IN AN AUTOMATIC SEWING MACHINE

FIELD OF THE INVENTION

This invention relates to a device for moving a cloth clamp under which tailoring cloths are pressed to be sewn on a sewing work table. Particularly, this invention relates to a mechanism for moving a cloth clamp or a presser foot to accommodate variations in density of the sewing operation including, for instance, condensed stitch at an end in a pocket formation on a fabric suit.

BACKGROUND OF THE INVENTION

A cloth clamp set in an automatic sewing machine is normally required to vary the speed at which the cloth clamp travels so that a stitch needle is able to make a halt stitch (or stop stitch) and a condensed stitch at the start and end of a travel, as well as stitch with an acceptable sewing speed in a normal manner. Further, movement of the cloth clamp with a high speed is desired while the stitch needle is idle or out of stitch service.

Conventional devices proposed in connection with the above art have been designed including extremely complex electro-mechanical elements having especially designed solenoid-operated valves which are necessary to control oil flow through a number of by-pass lines. Therefore, individual parts of such devices had to be of high grade. The finished mechanism then became, as a whole, so intricate that such conventional devices are only employed in the manufacture of highly priced gentleman's suits. But, because of the high grade parts, employment of such conventional devices has been difficult in tailoring lower priced fabric products, for instance, working uniforms. This difficulty has prevented the popularizing of such an automatic sewing machine in the tailoring business.

SUMMARY OF THE INVENTION

The principal object of this invention is to provide a simple electro-mechanical circuit useful for moving a cloth clamp in accordance with the necessary variations in stitch speed to be met in a sewing cycle. The circuit comprises a drive cylinder and associated piston where one side space of the piston is filled with hydraulic oil and the other by a gas such as air. In particular, one directional stroke (a backward stroke) of the piston, irrespective of stitch operation, introduces the hydraulic oil or non-compressible medium into circuit pipes and a reciprocal stroke thereof (a forward stroke) for performing the stitch work is actuated by a compressible medium which is counterbalanced by the working hydraulic oil. Then, simple control elements are utilized to define a plurality of branches to readily achieve different desired speeds of the cloth clamp.

Other features and advantages available from this invention will be apparent from the following descriptions.

Figure 1:
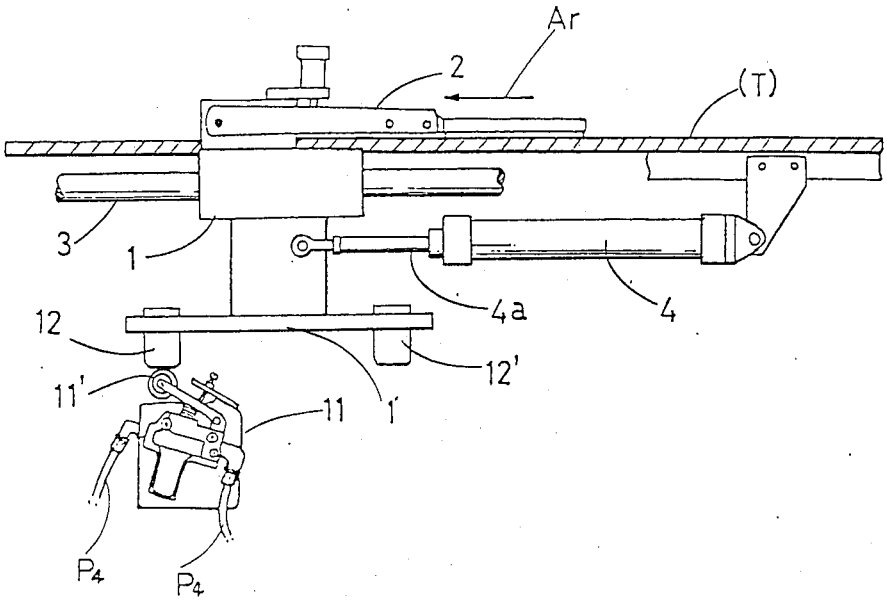
FIG. 1 is an elevation view of a main mechanical layout including a cloth clamp and a sectional view in part.

These drawings are presented by way of illustrating specific embodiments of the invention. Therefore, these should not be construed as limiting the invention.

DETAILED DESCRIPTION OF THE PREFERRED EMBODIMENT

Hereinbelow, the invention will be detailed with reference to a preferred embodiment illustrated in the drawings.

In FIG. 1 a slide carriage 1 is shown for holding a cloth clamp 2 which is disposed to press tailoring cloths (not shown) on a work table (T). Cloth clamp 2 is slidably guided with the aid of a guide rail 3. A drive cylinder 4 is secured horizontally at almost the same level as carriage 1. A piston 4*a* is reciprocably set or engaged in cylinder 4, and piston 4*a* is connected at one end with carriage 1. Carriage 1 is also provided with an extension 1' having a length comparable with two control points in a travel, which will be referred to hereinlater, in the direction parallel to guide rail 3 or the sliding movement of carriage 1. Two projections or blocks 12, 12' are mounted, respectively, at the front and back end of the extension 1' with a space therebetween. As will be described later, blocks 12, 12' are adapted to engage and to turn angularly a contact switch 11' of a check valve 11. Arrow Ar in FIG. 1 indicates the forward direction in the same way as in FIG. 2.

Figure 2:
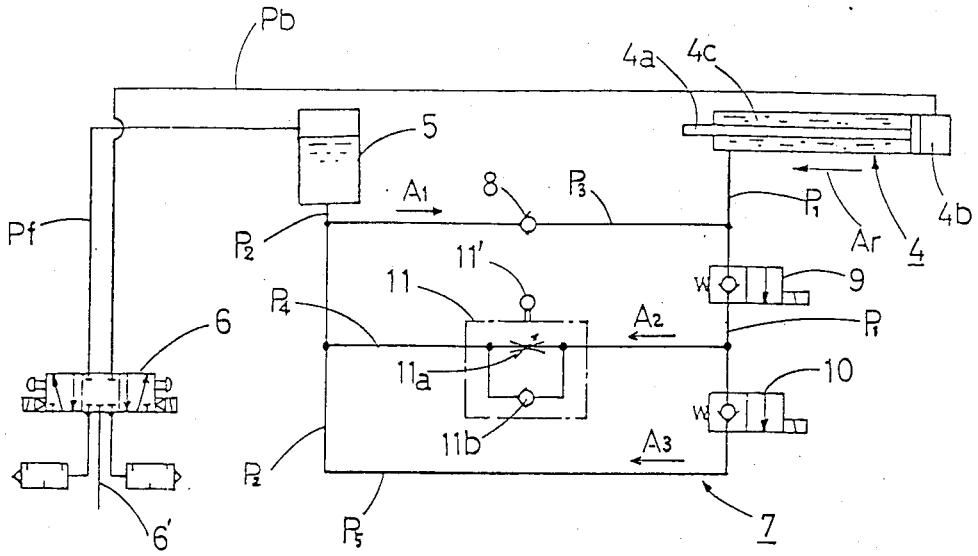
FIG. 2 is a diagram for a control circuit to operate the clamp.

In FIG. 2, a five port three position solenoid operated valve 6 is used to supply and to exhaust pressurized air from an air source 6' to two different service points, namely, an oil accumulator 5 and a pneumatic side 4*b* of cylinder 4 via lines Pf, Pb respectively. Accumulator 5 is arranged to actuate hydraulic pipe lines or a hydraulic circuit 7 entering into an oil side 4*c* of cylinder 4 via branched or shunted routes.

A first branch route (which will be noted as a backward route) is the line formed of line portions P2, P3 and Pl. A check valve 8 is disposed in line portion P3 to permit a flow as indicated by an arrow Al to cause a backward movement of piston 4*a*. A second branch route (which will be noted as a low and intermediate route) is the line formed of lines P2, P4, and Pl, which permits a flow as indicated by an arrow A2. A two part two position solenoid operated valve 9 is disposed on line portion Pl and disposed on line portion P4 is a flow control valve 11. Flow control valve 11 is equipped with a throttle valve ll*a* and a check valve ll*b* in parallel, and also with angularly turnable contract switch 11' discussed above and also shown in FIG. 1. A third branch route (which will be noted as a high speed route) is formed of line portions P2, P5 and Pl to permit a flow as indicated by an arrow A5. Solenoid valve 9, noted above, and another one solenoid valve 10 of the same type are disposed on line portion Pl.

As will be understood from the following description, a backward movement of piston 4*a* is merely a stroke or a movement for a reset action of cloth clamp 2. This movement serves to supply hydraulic oil back into circuit 7 as well as cylinder oil side 4*c* as a whole. On the other hand, a forward movement thereof (the direction of the arrow Ar) is for moving cloth clamp 2 utilizing electro-mechanical functions of the invention.

Figure 3:
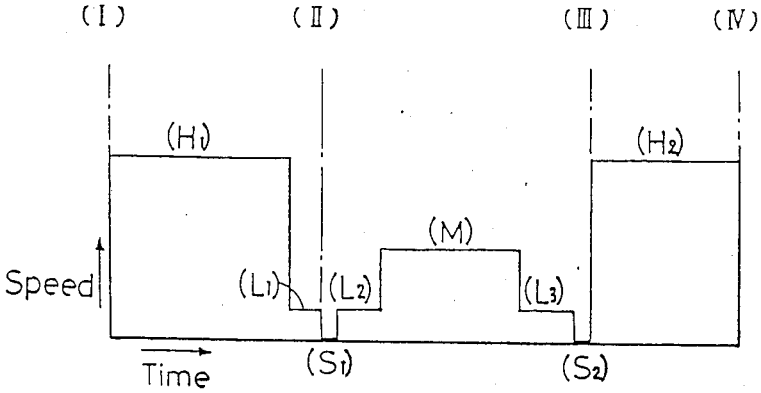
FIG. 3 is a speed-time chart of the clamp during an exemplary travel.

Referring now to FIG. 3 which shows a typical speed variation in time for cloth clamp 2, a time portion of (I) to (II) is a preliminary time of movement up to a stitch job which stitch job is indicated by the next time portion of (II) to (III), and the last time portion of (III) to (IV) is a movement after finishing of the stitching and wherein:

H1 is a high speed travel without stitch,

L1 is a low speed approach to a stitch start without stitch,

S1 is a halt stitch at the stitch start (II),

L2 is a condensed stitch with a low speed,

M is a normal stitch with an intermediate speed,

L3 is a low speed condensed stitch near the end,

S2 is a halt stitch at the end (III),

H2 is a high speed travel without stitch work.

The operation of the present invention is hereafter explained with reference to the operations and behaviors of cloth clamp 2 and related elements in connection with the movement thereof as shown in FIG. 3. At the start of the movement (I), piston 4*a* has been brought to the backward position in cylinder 4 by a reset action in the previous cycle and valve 6 is set to supply air to cylinder side 4*b*. Then, piston 4*a* is allowed to start moving with a high speed (H1) by the action of opening the two serial valves 9, 10. At the end of high speed travel (H1), contact element 11' engages with projection 12. This effects closure of valve 10 to stop the flow of oil through the third route and the opening of throttle valve ll*a* which provides a reduced flow path for the oil to use the second route and thus for cloth clamp 2 to move at the low speed (L1).

At the stitch start (II), valve 9 is controlled by a timer device (not shown) to close for time (S1). When valve 9 is closed, cloth clamp 2 is stopped and the.halt stitch is allowed. It should be appreciated that FIG. 1 shows slide carriage 1 positioned at the halt stitch stage. Next, cloth clamp 2 is moved forward at low speed (L2) when time S1 expires. The moment that switch 11' is disengaged, the throttle effect of check valve 11 is lost so that cloth clamp 2 then moves at the speed of the intermediate level (M). The next action is re-engagement of switch 11 and the projection 12', which again causes increased throttling of throttle valve 11*a* and which reduces the speed of cloth clamp 2 down to the low level (L3). Finally, cloth clamp is stopped for the halt stitch (S2) by the timer device (not shown).

At the stitch end (III), valve 10 is opened and cloth clamp 2 is sent to the travel end (IV) with a high speed (H2). Thus, one forward cycle is completed by the above sequence. Then, piston 4*a* is moved backward or reset by action of valve 6 in preparation of the next cycle.

It is believed that the descriptions hereinabove have disclosed the invention in detail such that various advantages are apparent. One such advantage is that during the forward travel, the actuating or supplying medium is pneumatic air and the exhausting medium is hydraulic oil. Thus, the setting of a stop point and speed control for the cloth clamp are accomplished with high accuracy with relatively simple electro-mechanical elements in the present invention. Another advantage is that the electro-mechanical elements included in the invention are those readily available in the market. In addition, the inventive control device may be manufactured in such a compact apparatus that sewing machines intended for popular tailoring products are able to employ the inventive device.

It is further understood by those skilled in the art that the foregoing descriptions are directed to a preferred embodiment of the disclosed device and that various changes and modifications may be added to the invention without departing from the spirit and scope thereof.

I claim:

1. A device for moving a cloth clamp attached to a slide carriage in an automatic sewing machine comprising:

a drive cylinder and associated piston, said piston being attached to the slide carriage whereby the slide carriage and cloth clamp are moved reciprocally by respective reciprocal movements of said piston in said cylinder;

a pneumatic circuit which supplies a compressible gas to said cylinder to move said piston in a forward stroke;

a hydraulic circuit including (a) a first branch which supplies hydraulic fluid to said cylinder to move said piston in a backward stroke, (b) a second branch through which fluid from said cylinder is exhausted during the forward movement of said piston, said second branch including a control valve and a throttle valve disposed in series whereby the forward stroke of the piston is slowed by said throttle valve to an intermediate speed and halted by closure of said control valve, and (c) a third branch through which fluid from said cylinder is exhausted during the forward movement of said piston, said third branch also providing a shunt route for said second branch, and including a control valve whereby fluid from said cylinder is exhausted rapidly when said control valve is opened to effect a rapid forward stroke of said piston; and a throttle actuating means for actuating said throttle valve of said second branch to effect a further slowing of the forward stroke of said piston, whereby the forward movement of the cloth clamp is reduced to a slow speed;

whereby a forward movement of the cloth clamp is effected by said second branch such that a halt stich is performed when the cloth clamp is stopped, a condensed stich is performed when said throttle actuating means actuates said throttle valve and the cloth clamp is moved with the forward stroke of said piston at the slow speed, and a normal stich is performed when the cloth clamp is moved with the forward stroke of said piston at the intermediate speed, and whereby a rapid forward movement of the cloth clamp is effected by said third branch when no stiching is occuring.

2. A device as claimed in claim 1 wherein said slide carriage includes an extension having a length comparable with a predetermined distance of movement of said piston; and wherein said throttle actuating means includes a contact element located adjacent a line of travel of said extension and adapted to be moved to operate said throttle valve and a plurality of projections which extend from said extension such that said projections engage and move said contact element as said extension passes thereby; whereby reduction of the forward movenment of said piston from the intermediate speed to the slow speed is effected while one of said projections engages said contact element.

* * * * *